US012350540B1

(12) United States Patent
Chen

(10) Patent No.: US 12,350,540 B1
(45) Date of Patent: Jul. 8, 2025

(54) AUTOMATIC PLATE-CHANGING INTEGRATED DUMBBELL

(71) Applicant: Wuyi Boda industry and trade Co., LTD., Jinhua (CN)

(72) Inventor: Youben Chen, Hangzhou (CN)

(73) Assignee: Wuyi Boda industry and trade Co., LTD., Jinhua (CN)

( * ) Notice: Subject to any disclaimer, the term of this patent is extended or adjusted under 35 U.S.C. 154(b) by 0 days.

(21) Appl. No.: 19/070,529

(22) Filed: Mar. 5, 2025

(30) Foreign Application Priority Data

Dec. 27, 2024 (CN) ..... 202423250951.2

(51) Int. Cl.

| | |
|---|---|
| ***A63B 21/075*** | (2006.01) |
| ***A63B 21/072*** | (2006.01) |
| ***A63B 24/00*** | (2006.01) |
| ***A63B 71/00*** | (2006.01) |

(52) U.S. Cl.
CPC ..... *A63B 21/075* (2013.01); *A63B 21/0726* (2013.01); *A63B 21/0728* (2013.01); *A63B 24/0087* (2013.01); *A63B 71/0036* (2013.01)

(58) Field of Classification Search
CPC ..... A63B 21/075; A63B 21/0726; A63B 21/0728
See application file for complete search history.

(56) References Cited

U.S. PATENT DOCUMENTS

2007/0184945 A1* 8/2007 Lin ..... A63B 21/075 482/107
2009/0305852 A1* 12/2009 Hoglund ..... A63B 21/075 482/107
2012/0115689 A1* 5/2012 Dalebout ..... A63B 21/0728 482/107
2013/0231224 A1* 9/2013 Svenberg ..... A63B 21/072 482/107
2022/0193481 A1* 6/2022 Wu ..... A63B 21/0728
2023/0052772 A1* 2/2023 Wang ..... A63B 71/0036
2023/0173328 A1* 6/2023 Wu ..... A63B 21/075 482/107
2023/0347200 A1* 11/2023 Casagrande ..... A63B 21/075
2025/0065180 A1* 2/2025 Li ..... A63B 21/0728

FOREIGN PATENT DOCUMENTS

CN 212187619 U * 12/2020
CN 114028764 A * 2/2022

* cited by examiner

*Primary Examiner* — Joshua T Kennedy
(74) *Attorney, Agent, or Firm* — Ying-Ting Chen

(57) ABSTRACT

An automatic plate-changing integrated dumbbell includes a dumbbell and a base to limit and place the dumbbell; where the dumbbell includes: a grip rod; two retractable rods are telescopically mounted inside the grip rod to support the plurality of weight plates at the ends of the dumbbell; a spiral driving groove is formed inside the grip rod to drive the retractable rod to expand and retract; an outer periphery of the retractable rod is formed with a driving protrusion to match the spiral driving groove; through holes are formed at a center of the plurality of weight plates to be inserted with the retractable rod; and two ends of the grip rod are respectively provided with indexing-telescoping assemblies to limit linear movements of the two retractable rods and to index and telescope the retractable rods.

16 Claims, 8 Drawing Sheets

AUTOMATIC PLATE-CHANGING INTEGRATED DUMBBELL

CROSS-REFERENCE TO RELATED APPLICATIONS

This application claims priority to Chinese Patent Application No. 202423250951.2, filed on Dec. 27, 2024, the content of which is incorporated herein by reference in its entirety.

TECHNICAL FIELD

The present disclosure relates to an automatic plate-changing integrated dumbbell which is conducive to adjusting weight plates.

BACKGROUND

The conventional dumbbell has a structure in which weight plates are sleeved at two ends of the grip rod of the dumbbell, and then threaded end caps are sleeved at two ends of the grip rod to press the weight plates. In this way, when the weight plate needs to be replaced, the threaded end caps need to be removed, and then the number of weight plates needs to be disassembled and assembled according to the user's own needs. After the adjustment is completed, the weight plates are fixed by tightening the threaded end cap. The structure of such dumbbells is too simple, the adjustment operation of the weight plates is complicated, time-consuming, and labor-intensive, and the efficiency is low, thus affecting the user's experience.

SUMMARY

The present disclosure provides an automatic plate-changing integrated dumbbell to solve the above-mentioned technical problems, and specifically adopts the following technical solution:

An automatic plate-changing integrated dumbbell comprises a dumbbell and a base to limit and place the dumbbell; two ends of the base are respectively provided with supporting plates to limit and place the weight plates at two ends of the dumbbell and positioning plates to position and place the dumbbell. A placement space to place a plurality of weight plates is formed between the supporting plate and the positioning plate. The dumbbell comprises: a grip rod. Two retractable rods to support the plurality of weight plates at the end of the dumbbell are telescopically mounted inside the grip rod. A spiral driving groove to drive the retractable rod to expand and retract is formed inside the grip rod. The outer periphery of the retractable rod is formed with a driving protrusion to match with the spiral driving groove. The through holes are formed at a center of the plurality of weight plates to be inserted with the retractable rod. Two ends of the grip rod are respectively provided with indexing-telescoping assemblies to limit linear movements of the two retractable rods and index and telescope the retractable rods, so that each degree of rotating the retractable rod corresponds to the position of one weight plate. The retractable rod is provided with a weight plate fixing assembly to drive and fix the weight plates in a case where the retractable rod is prevented from expanding and retracting by the indexing-telescoping assembly, or to drive and release the weight plates in a case where the retractable rod is allowed to expand and retract by the indexing-telescoping assembly.

Further, the indexing-telescoping assembly comprises a flange plate rotatably connected to an end of the grip rod and an indexing ring fixed to the end of the grip rod and embedded inside the flange plate. A plurality of indexing pins is provided inside a plurality of indexing holes evenly distributed in a circumferential direction of the indexing ring. A spiral driving groove to drive the retractable rod to expand and retract is formed inside the grip rod. The outer periphery of the retractable rod is formed with a driving protrusion to match with the spiral driving groove. The flange plate is formed with a positioning hole for the indexing pin to be inserted to prevent the retractable rod and the grip rod from rotating relatively. The indexing pin is provided with a spring to insert the pinhead of the indexing pin into the positioning hole. The positioning plate is provided with a release pin to insert the positioning hole to eject the indexing pin out of the positioning hole when the dumbbell is placed on the positioning plate. The flange plate is provided with an L-shaped guide seat to limit the linear movement of the retractable rod. The retractable rod is formed with a guide groove to match with the L-shaped guide seat. The L-shaped guide seat is provided with an ejector rod slidably arranged in the hole formed in the L-shaped guide seat. The ejector rod moves between a position where the ejector rod is inserted into the indexing hole and a position where the ejector rod disengages from the indexing hole and retracts into the hole formed in the L-shaped guide seat.

Further, the indexing-telescoping assembly further comprises a code ring and a pressing cover. The code ring is sleeved on the outer periphery of the end of the grip rod and a gap is formed between the code ring and the grip rod. The pressing cover is sleeved on the outer periphery of the grip rod and is expanded into the gap to fix the code ring to the end of the grip rod. The pressing cover, the code ring, and the indexing ring are fixed as a whole by a plurality of screws.

Further, a part of the flange plate is sleeved on the outer periphery of the indexing ring, and a retaining ring to limit the axial positions of the flange plate and the indexing ring is also provided between the flange plate and the indexing ring.

Further, the spiral driving groove is a spiral groove having an arc-shaped inner wall. The driving protrusion is formed by a steel ball rolling embedded on the outer wall of the retractable rod.

Further, the weight plate fixing assembly comprises a rotating shaft rotatably arranged inside the retractable rod. The end of the rotating shaft away from the grip rod is fixed with a cam. The end of the retractable rod away from the grip rod is provided with a clamping pin. The through hole of the weight plate is provided with a clamping groove to clamp the clamping pin. The clamping pin is telescopically arranged in the sliding hole formed at the end of the retractable rod by an elastic member. A torsion spring is arranged between the end of the rotating shaft away from the cam and the inner wall of the retractable rod to drive a convex portion of the cam to eject the clamping pin. The end of the ejector rod is connected to the rotating shaft to push the rotating shaft to rotate in a case where the ejector rod is ejected out of the indexing hole by the indexing pin, so as to misalign the convex portion of the cam with the clamping pin and cause the clamping pin to retract back into the sliding hole.

Further, the rotating shaft is formed with a toggle rim to contact the ejector rod. The upper end of the ejector rod is provided with an arc-shaped push rod, and the end of the arc-shaped push rod is abutted and contacted against the toggle rim and is attached to the rotating shaft.

Further, the end of the retractable rod is provided with a plurality of clamping pins in the circumferential direction. A plurality of convex portions and concave portions provided at intervals are formed on the periphery of the cam. Each clamping pin is movable between contacting the corresponding convex portion and contacting the corresponding concave portion.

Further, the base is provided with two supporting shafts to support and limit the weight plates from two sides of the weight plate. Two supporting shafts penetrate the supporting plate and the positioning plate from two sides of the supporting plate and the positioning plate.

Further, the positioning plate forms a recess to engage the flange plate. The recess is provided with a release pin.

The disclosure has the advantages that the provided automatic plate-changing integrated dumbbell can linearly drive the retractable rod through the spiral driving groove to linearly expand and retract along the inside of the grip rod by rotating the grip rod under the structural limitation of the indexing-telescoping assembly, so that one end of the retractable rod is inserted with a required number of weight plates, and then the weight plates inserted on the outer periphery of the retractable rod are fixed by the weight plate fixing assembly, so that the number of weight plates of the dumbbell can be quickly changed. There is no need for the operation of disassembling and assembling the weight plates, the adjustment structure is simple, the efficiency is high, the time and labor are saved, and the user's experience is effectively improved.

BRIEF DESCRIPTION OF THE DRAWINGS

In order to more clearly explain the technical solutions in the embodiments of the present application or the prior art, the drawings that need to be used in the description of the embodiments or the prior art will be briefly introduced below, and it is obvious that the drawings in the following description are only some embodiments of the present application, and other drawings can be obtained from these drawings without making creative labor for those skilled in the art.

DETAILED DESCRIPTION OF THE EMBODIMENTS

Figure 1:
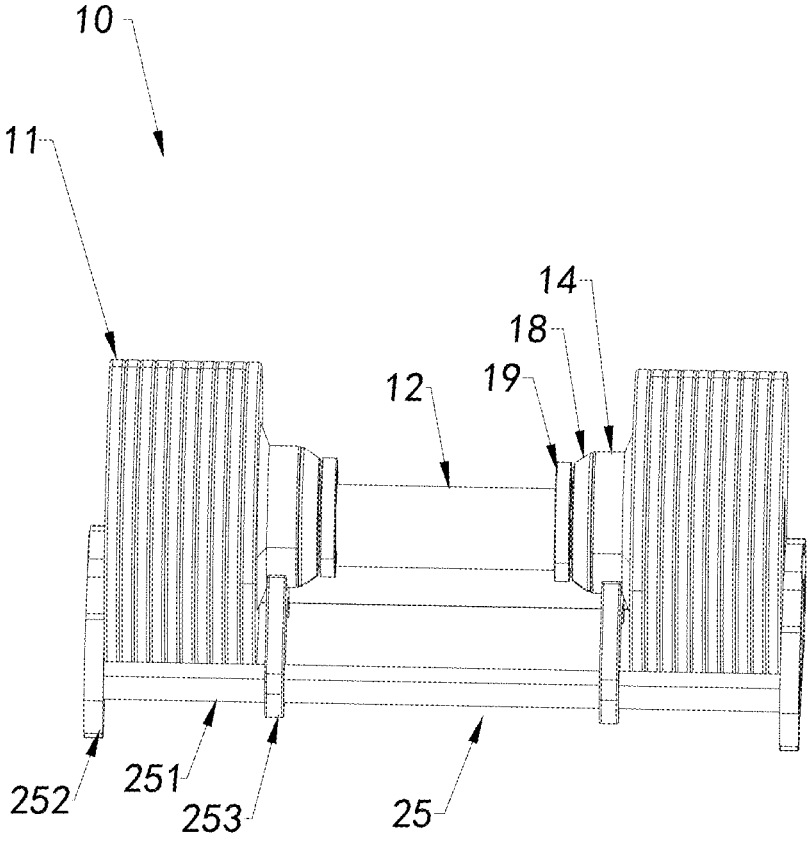
FIG. 1 is a schematic diagram of an automatic plate-changing integrated dumbbell of the present disclosure.

Hereinafter, embodiments of the present application are described in detail, examples of which are shown in the accompanying drawings, in which the same or similar reference numerals denote the same or similar elements or elements having the same or similar functions throughout. The embodiments described below with reference to the accompanying drawings are exemplary and are intended to be used to explain the present application, and are not to be construed as limiting the present application.

Figure 2:
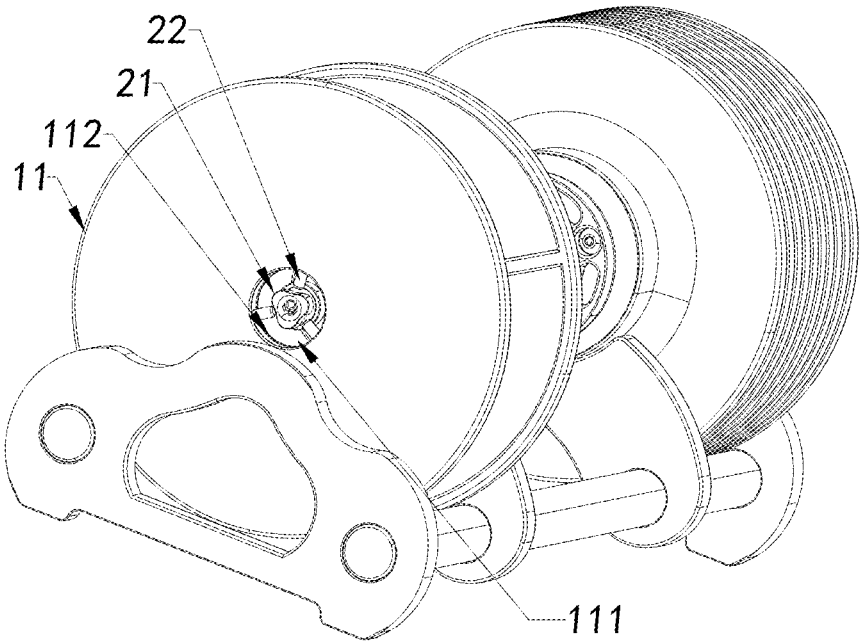
FIG. 2 is a schematic view of the internal structure of the automatic plate-changing integrated dumbbell of FIG. 1.
Figure 3:
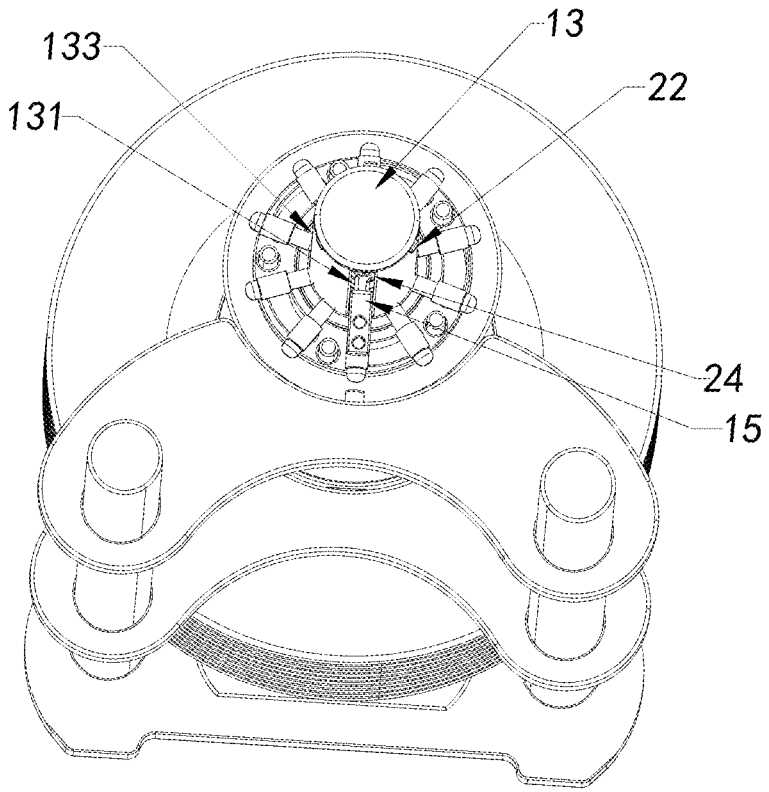
FIG. 3 is a schematic diagram of the indexing-telescoping assembly and the weight plate fixing assembly of the automatic plate-changing integrated dumbbell in FIG. 1.
Figure 4:
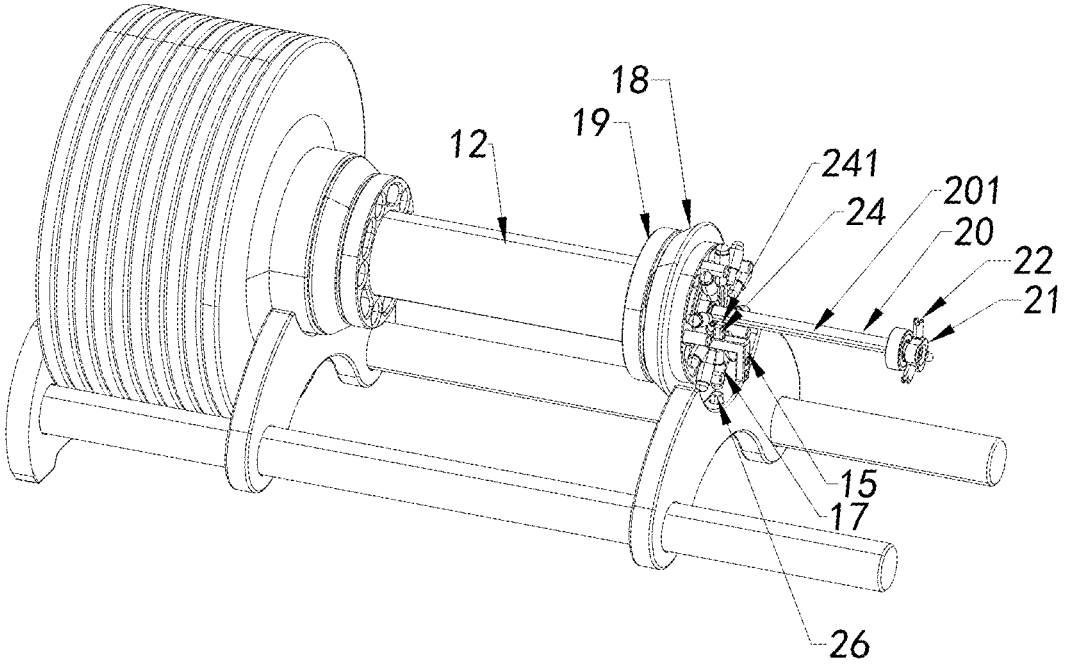
FIG. 4 is a schematic view of a partial structure of the indexing-telescoping assembly and the weight plate fixing assembly of the automatic plate-changing integrated dumbbell in FIG. 1.
Figure 5:
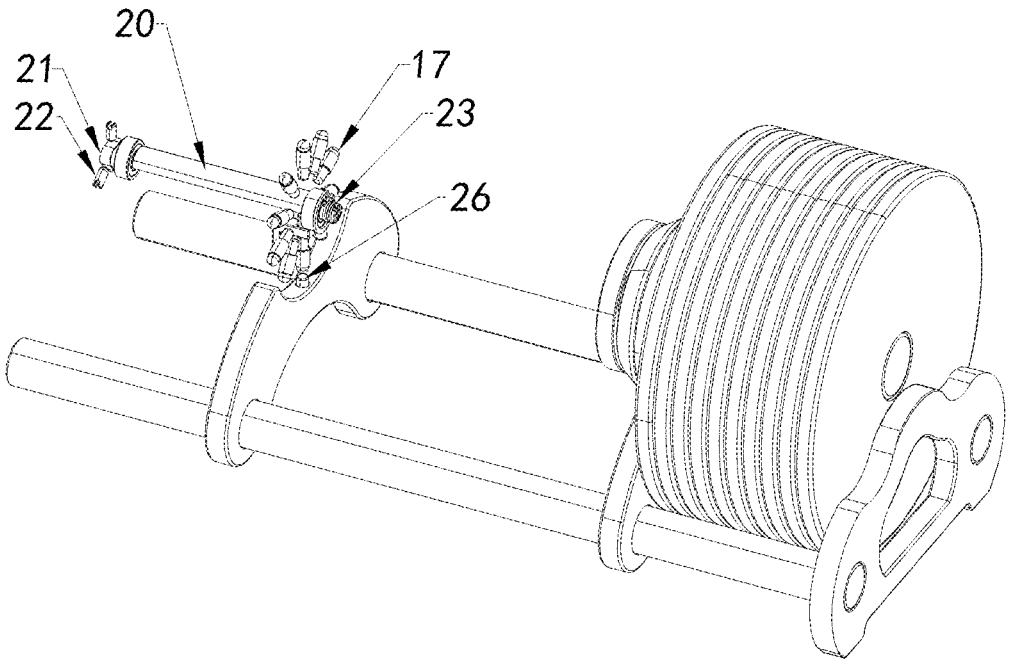
FIG. 5 is a schematic diagram of the mounting structure of the rotating shaft and the torsion spring of the automatic plate-changing integrated dumbbell in FIG. 1.
Figure 6:
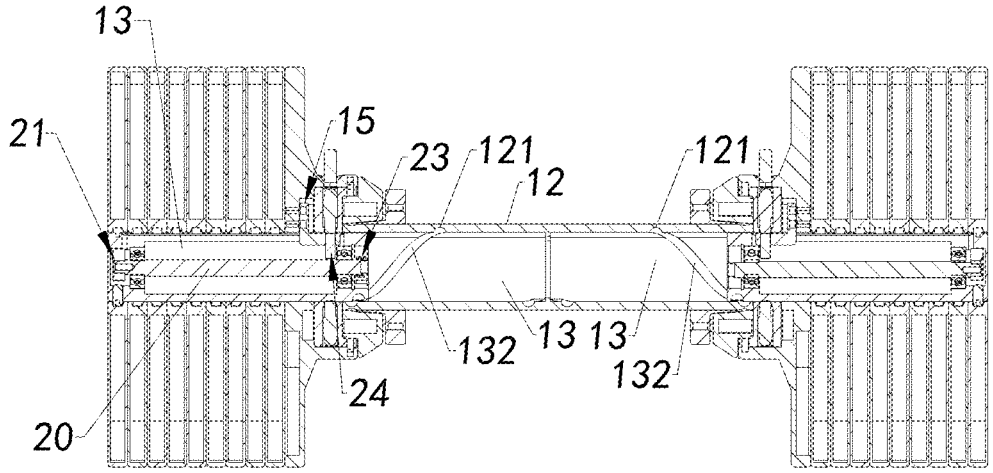
FIG. 6 is a sectional view of the automatic plate-changing integrated dumbbell of FIG. 1.
Figure 7:
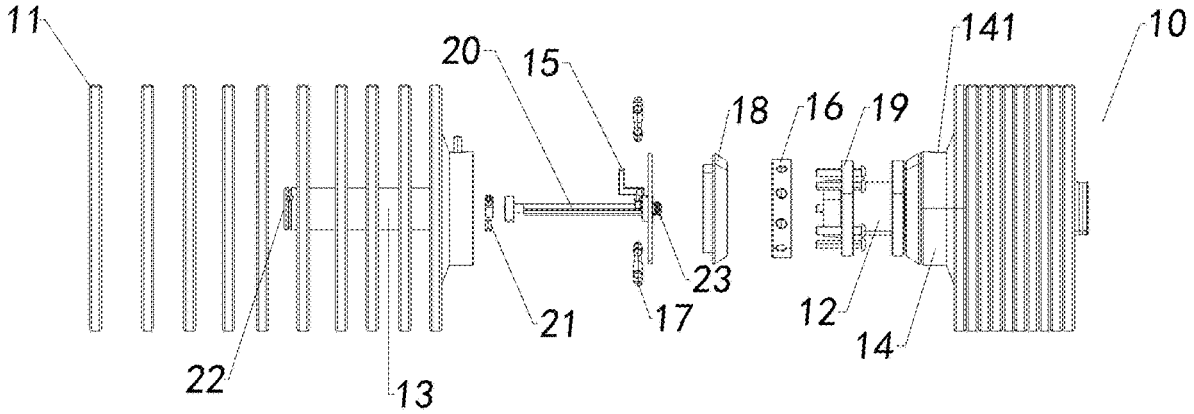
FIG. 7 is an explosive view of the automatic plate-changing integrated dumbbell of FIG. 1.
Figure 8:
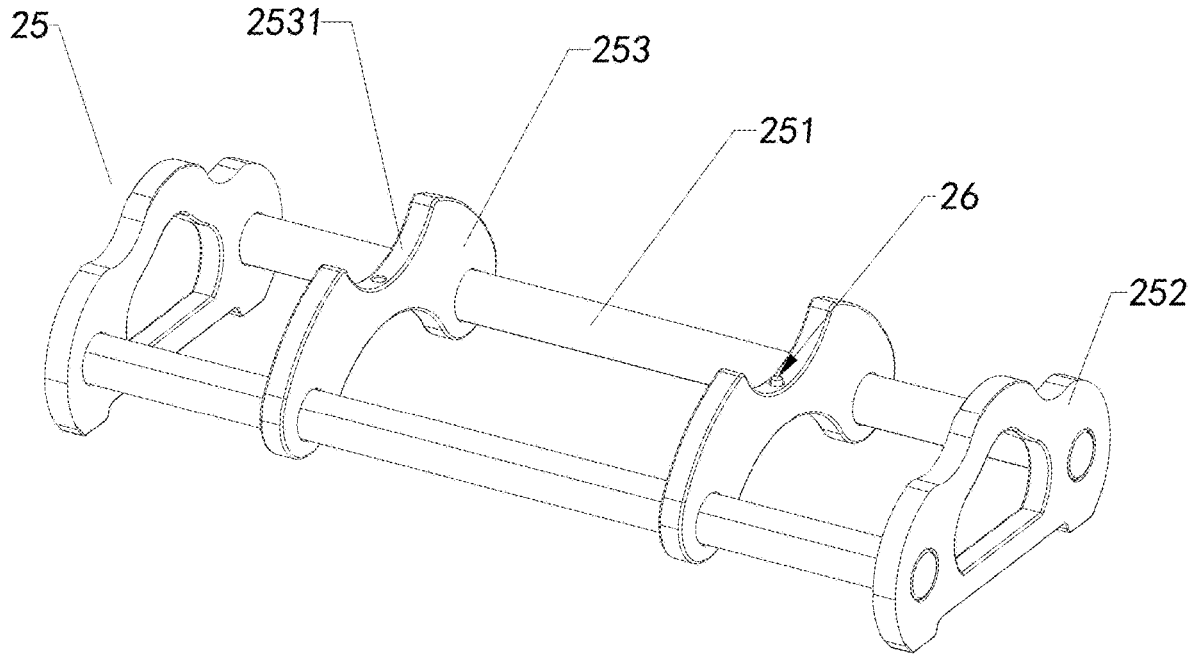
FIG. 8 is a schematic view of the base of the automatic plate-changing integrated dumbbell of FIG. 1.

As shown in FIGS. 1 to 8, an automatic plate-changing integrated dumbbell is provided according to the present disclosure and comprises a dumbbell 10 and a base 25. The base 25 is used to limit the position of the whole dumbbell 10. Two ends of the base 25 are respectively provided with supporting plates 252 and positioning plates 253, the supporting plates 252 are used to limit and place the weight plates 11 at two ends of the dumbbell 10, the positioning plates 253 are used to position and place the dumbbell 10, and a plurality of weight plates 11 at two ends of the dumbbell 10 is placed in the placement space formed between the supporting plates 252 and the positioning plates 253. The dumbbell 10 comprises a grip rod 12, and two retractable rods 13 are telescopically mounted in the grip rod 12, and the retractable rods 13 can adjust the number of weight plates 11 supporting the end portion of the dumbbell 10 when telescopically expanded. A spiral driving groove 121 to drive the retractable rod 13 to expand and retract is formed inside the grip rod 12, and a driving protrusion 132 to match with the spiral driving groove 121 is formed on the outer periphery of the retractable rod 13, and the driving protrusions 132 of the two retractable rods 13 have spiral directions opposite to each other, so that the two retractable rods 13 inside can be driven to expand and retract by rotating the grip rod 12. A through hole 111 is formed at the center of the plurality of weight plates 11 to insert the retractable rod 13 during expansion and retraction. Two ends of the grip rod 12 are respectively provided with an indexing-telescoping assembly, through which two retractable rods 13 can be limited to move linearly, and the retractable rods 13 can be indexed and telescoped at the same time, so that each degree of rotation of the retractable rod 13 corresponds to a position of one weight plate 11. That is, each time the grip rod 12 is rotated by one degree by indexing, one corresponding weight plate 11 is inserted into the retractable rod 13, so that it can be clearly known how many weight plates 11 are inserted into the retractable rod 13. An indexing display sign is correspondingly marked between the grip rod 12 and the indexing-telescoping assembly.

Further, the retractable rod 13 is provided with a weight plate fixing assembly, and the weight plate fixing assembly is linked with the mechanism of indexing-telescoping assembly, that is, the indexing-telescoping assembly can drive the weight plate fixing assembly to fix the weight plate 11 when the retractable rod 13 is prevented from expanding and retracting, or the indexing-telescoping assembly can drive the weight plate fixing assembly to release the weight plate 11 when the retractable rod 13 is allowed to expand and retract.

Therefore, according to the automatic plate-changing integrated dumbbell, under the structural limitation of the indexing-telescoping assembly, the retractable rod 13 can be linearly driven through the spiral driving groove 121 to expand and retract along the inside of the grip rod 12, so that one end of the retractable rod 13 can be inserted with a required number of weight plates 11, and then the weight plates 11 inserted on the outer periphery of the retractable rod 13 can be fixed by the weight plate fixing assembly, so that the number of weight plates 11 of the dumbbell 10 can be quickly changed. Without the operation of disassembling and assembling the weight plates 11, the weight plates 11 can be adjusted and changed only by rotating the grip rod 12, the adjustment structure is simple, the efficiency is high, the time and labor are saved, and the user's experience is effectively improved. The mechanism of the weight plate fixing assembly and the indexing-telescoping assembly is designed as a linked integrated structure, so that the adjustment operation is smooth, silky, and timely without other auxiliary operations.

As a specific structure, the indexing-telescoping assembly comprises a flange plate 14 rotatably connected to the end of the grip rod 12, and an indexing ring 16 fixed to the end of the grip rod 12 and embedded inside the flange plate 14. A plurality of indexing holes are evenly distributed in the circumferential direction of the indexing ring 16, each indexing hole is provided with an indexing pin 17 capable of expanding and retracting, and the flange plate 14 is formed with a positioning hole 141, the indexing pin 17 can be inserted into the positioning hole 141, so that the flange plate 14 and the grip rod 12 rotate relatively, that is, the retractable rod 13 is prevented from expanding and retracting. A spring is provided in the indexing pin 17 to drive the pinhead of the indexing pin 17 into the positioning hole 141 when the indexing pin 17 is aligned with the positioning hole 141. The positioning plate 253 is provided with a release pin 26, and when the dumbbell 10 is placed on the positioning plate 253, the release pin 26 is inserted into the positioning hole 141 to push the indexing pin 17 out of the positioning hole 141, so that the retractable rod 13 and the grip rod 12 can be returned to a state in which relative rotation can occur. The flange plate 14 is mounted with an L-shaped guide seat 15, the retractable rod 13 is formed with a guide groove 131 to match with the L-shaped guide seat 15, and the retractable rod 13 can be limited to move linearly by the limited matching between the L-shaped guide seat 15 and the guide groove 131. An ejector rod 24 is slidably provided in the hole formed in the L-shaped guide seat 15, and one end of the ejector rod 24 moves between a position where the ejector rod 24 is inserted into the indexing hole and a position where the ejector rod 24 is disengaged from the indexing hole and retracted into the hole formed in the L-shaped guide seat 15.

Specifically, in a case where the dumbbell 10 is placed on the base 25, the unique positioning hole 141 in the radial direction of the flange plate 14 is matched down in alignment with the release pin 26 on the positioning plate 253. Due to the self-weight of the dumbbell 10, the release pin 26 is inserted into the positioning hole 141, the outer end surface of the release pin 26 is just flush with the fitting surface of the opening of the positioning hole 141 and the opening of the corresponding indexing hole thereof, the lower end surface of the indexing pin 17 is also just flush with the fitting surface, the upper end of the indexing pin 17 pushes the ejector rod 24 out of the indexing hole, and just makes the lower end surface of the ejector rod 24 positioned between the indexing ring 16 and the retractable rod 13. In this way, the indexing ring 16 can rotate along with the grip rod 12, thereby realizing the telescopic adjustment of the retractable rod, and further adjusting the number of weight plates 11 to be supported and mounted. However, in a case where the dumbbell 10 is lifted, the ejector rod 24 is not ejected by the indexing pin 17, i.e. one end of the ejector rod 24 is caught in the indexing hole of the indexing ring 16. The lower end of the indexing pin 17 is engaged in the positioning hole 141. In this way, the retractable rod 13, the indexing ring 16 (i.e. the grip rod 12), and the flange plate 14 cannot rotate relatively, that is, the indexing ring 16 cannot rotate in the flange plate 14, and the retractable rod 13 cannot be expanded and retracted, thereby completing the adjustment of the number of weight plates 11.

In other words, in a case where the dumbbell 10 is used away from the base 25, the indexing pin 17 is extended and engaged with the positioning hole 141 of the flange plate 14, so that the flange plate 14 cannot rotate relative to the grip rod 12, and in this case, the retractable rod 13 in the grip rod 12 cannot be expanded or retracted. In a case where the dumbbell 10 is placed on the base 25, the release pin 26 on the positioning plate 253 is inserted into the positioning hole 141 of the flange plate 14, so that the flange plate 14 cannot rotate when the dumbbell 10 is placed on the base 25. When the grip rod 12 is rotated in such manner, the flange plates 14 at two ends of the grip rod 12 do not rotate accordingly.

Specifically, the positioning plate 253 is formed with a recess 2531 to engage the flange plate 14, and the release pin 26 is provided in the recess 2531. In a case where the dumbbell 10 is placed on the base 25, the flange plate 14 is directly engaged in the recess 2531, allowing the release pin 26 to be directly aligned with the positioning hole 141 of the flange plate 14.

As a specific structure, the weight plate fixing assembly comprises a rotating shaft 20, and two ends of the rotating shaft 20 are rotatably provided inside the retractable rod 13 by a rolling bearing. The end of the rotating shaft 20 away from the grip rod 12 is fixed with a cam 21, the end of the retractable rod 13 away from the grip rod 12 is provided with a clamping pin 22, the through hole 111 of the weight plate 11 is provided with a clamping groove 112 for the clamping pin 22 to be engaged, the clamping pin 22 is telescopically arranged in a sliding hole 133 formed at the end of the retractable rod 13 by an elastic member, and a torsion spring 23 is arranged between the end of the rotating shaft 20 away from the cam 21 and the inner wall of the retractable rod 13. By the torsion spring 23, the convex portion of the cam 21 can push the clamping pin 22 out, so that the clamping pin 22 is maintained and engaged in the clamping groove 112, and the weight plate 11 is fixed. One end of the ejector rod 24 is connected to the rotating shaft 20 to push the rotating shaft 20 to rotate when the ejector rod 24 is ejected out of the indexing hole by the indexing pin 17, thereby causing the convex portion of the cam 21 to be misaligned with the clamping pin 22, causing the clamping pin 22 to retract into the sliding hole.

That is, after the release pin 26 is inserted into the positioning hole 141, the indexing pin 17 in the positioning hole 141 is ejected and the ejector rod 24 is ejected, the rotating shaft 20 can be pushed to rotate by the ejector rod 24, thereby displacing the convex portion of the cam 21 with the clamping pin 22, causing the clamping pin 22 to retract into the sliding hole 133, thereby releasing the weight plate 11 to allow the retractable rod 13 to linearly expand and retract. In this process, since the lower end of the ejector rod 24 is retracted between the inner circumferential side of the indexing ring 16 and the outer circumferential side of the retractable rod 13, the ejector rod 24 is ejected when any one of the indexing pins 17 rotationally moves past the ejector rod 24 following the indexing ring 16, and the inner side wall of the indexing ring 16 remains in contact with the ejector rod 24 when the indexing pins 17 rotationally move along with the indexing ring 16 and misaligned with the ejector rod 24. Thus, as long as the dumbbell 10 remains on the base 25, any indexing pin 17 aligned with the positioning hole 141 is retracted into the indexing plate due to the release pin 26, that is, the ejector rod 24 remains pushed, that is, the clamping pin 22 remains retracted inside the sliding hole.

Specifically, the rotating shaft 20 is formed with a toggle rim 201 to contact the ejector rod 24, the upper end of the ejector rod 24 is provided with an arc-shaped push rod 241, and the end of the arc-shaped push rod 241 is abutted and contacted against the toggle rim 201 and attached to the rotating shaft 20 through an arc surface, so that the pushing operation of the ejector rod 24 to the rotating shaft 20 is more stable.

Further, the end portion of the retractable rod 13 is provided with a plurality of clamping pins 22 in the circumferential direction, and a plurality of convex portions and concave portions provided at intervals are formed on the periphery of the cam 21, and each clamping pin 22 is movable between contacting the corresponding convex portion and contacting the corresponding concave portion. As described above, the locking stability of the weight plate 11 can be improved by the expansion and retraction of the plurality of clamping pins 22.

Based on the above structure, in operation, after the dumbbell 10 is placed on the positioning plate 253, the release pin 26 ejects the indexing pin 17 in the positioning hole 141, and the indexing pin 17 ejects the ejector rod 24 to drive the rotating shaft 20 to rotate in the forward direction against the torsion force of the torsion spring 23, and the rotating shaft 20 drives the cam 21 to rotate accordingly, so that the concave portion of the cam 21 corresponds to the clamping pin 22. In this way, the clamping pin 22 loses the jacking force, and is disengaged from the clamping groove 112 under the pulling force of the elastic member, and the weight plate 11 is released, so that the retractable rod 13 can expand and retract in the through holes 111 of the plurality of weight plates 11. At the same time, after the indexing pin 17 is disengaged from the positioning hole 141, the grip rod 12 can be rotated relative to the flange plate 14, and the retractable rod 13 is restricted to move linearly due to the structural cooperation between the L-shaped guide seat 15 on the flange plate 14 and the guide groove 131 of the retractable rod 13. In this way, when the grip rod 12 is rotated, the retractable rod 13 can be driven to expand and retract by the spiral driving groove 121. When the retractable rod 13 moves to the position of the weight plate 11 of the specified number of plates, the grip rod 12 is lifted, the release pin 26 is disengaged from the positioning hole 141, and the corresponding indexing pin 17 is inserted into the positioning hole 141. Also, the rotating shaft 20 rotates in the reverse direction under the torsion force of the torsion spring 23, thereby driving the cam 21 to rotate until the convex portion ejects the clamping pin 22, and the clamping pin 22 is engaged into the clamping groove 112 to realize the fixation of the weight plate 11. Also, the ejector rod 24 moves downward under the reverse drive of the cam 21 until its lower end is inserted into the corresponding indexing hole.

Through the above-described linked structure, the structures of adjusting the number of weight plates 11 and locking the number of weight plates 11 are integrated, and the operation is more convenient. With the driving structure of the spiral driving groove 121 and the driving protrusion 132 to telescopically adjust the retractable rod 13, the structure is simple, the cost is low, the error is small, and the telescopic adjustment is more accurate.

The conventional dumbbell fixing structure adopts the solution of fixing between the dumbbell weight plates by the engagement structure between the dumbbell weight plates, and needs to process notches or holes on the dumbbell weight plates, and the plastic clamping member needs to be embedded, which destroys the gravity balance of the dumbbell, and also has the same structure for each dumbbell weight plate, which also greatly increases the manufacturing cost, reduces the weight of the dumbbell, increases the whole size of the dumbbell, and the embedded member is also easily damaged and fell off, thus increasing the safety risk. Compared with the conventional solution, in the fixing structure of the weight plate 11 of the present disclosure, there are no notches, holes, or attachments except for the through hole 111 in the center, and the weight plate 11 retains a perfect gravity balance during use, thus further reducing the manufacturing cost. The weight plate 11 of the present disclosure is fixed by the self-gravity of the dumbbell 10, in which the release pin 26 pushes up the indexing pin 17, and then the indexing pin 17 pushes up the ejector rod 24, and the ejector rod 24 pushes the rotating shaft 20 to rotate to release the weight plate 11. That is, when the dumbbell 10 is placed, a series of movements mentioned above are caused, and when the dumbbell 10 is lifted, the movements are reversed in the opposite direction due to the elastic force of the spring and the torsion force of the torsion spring 23. Therefore, in the process of placing and lifting the dumbbell 10, the cam 21 on the rotating shaft 20 rotates forward and backward, and the clamping pin 22 attached to the surface of the cam 21 is retracted and extended, thereby realizing the disengagement and locking between the weight plate 11 and the retractable rod 13. The engagement structure has a simple structure, small components, and simple processing technology, which greatly saves the manufacturing cost. Also, under the same mass, the overall size of the dumbbell 10 of the present disclosure is smaller. In view of the principle of using the dumbbell 10 with large mass and small size, the technical solution of the present disclosure obviously improves the convenience of using the dumbbell 10, and the gravity balance of the weight plate 11 further improves the physical performance of using the dumbbell 10.

As a specific embodiment, the indexing-telescoping assembly further comprises a code ring 18 and a pressing cover 19. The code ring 18 is sleeved on the outer periphery of the end of the grip rod 12 to form a gap between the code ring 18 and the grip rod 12, and then the pressing cover 19 is sleeved on the outer periphery of the grip rod 12 and expanded into the gap, to fix the code ring 18 to the end of the grip rod 12. Then, the pressing cover 19, the code ring 18, and the indexing ring 16 are fixed integrally by a plurality of screws. In this way, the indexing ring 16 is fixed by the code ring 18 with the indexing value sign, so that the user can know the indexing-telescoping situation of the retractable rod 13 in real time, and thus can intuitively know the adjustment situation of the number of weight plates 11. Also, the connection between the grip rod 12 and the code ring 18 adopts the expansion type, instead of welding, screw fixation, or snap connection, the connection is convenient for disassembly, the structure is stable, the whole fixed structure can bear greater torque force and impact force, is not easy to fall off and deform, and the structure is simple.

Further, a part of the flange plate 14 is sleeved on the outer periphery of the indexing ring 16, and a retaining ring is further provided between the flange plate 14 and the indexing ring 16. The axial positions of the flange plate 14 and the indexing ring 16 can be limited by mounting the retaining ring in the slot on the outside of the indexing ring 16 and simultaneously snapping in the slot on the inside of the flange plate 14. In this way, in a case where the dumbbell 10 is placed on the base 25, the indexing pin 17 is disengaged from the flange plate 14, and when the grip rod 12 drives the indexing ring 16 to rotate within the flange plate, the retaining ring can prevent the axial movement of the indexing ring 16 in the direction towards the grip rod 12. Also, the rotational connection between the flange plate 14 and the indexing ring 16 is realized by the retaining ring, the structure is simple, with no redundant head protrusion of the spring, which does not affect the installation of other structures, and the installation structure accuracy is high.

As a specific embodiment, the spiral driving groove 121 is a spiral groove having an arc-shaped inner wall, and the driving protrusion 132 is formed by a steel ball rolling and embedded in the outer wall of the retractable rod 13. In this way, the steel ball is embedded in the retractable rod 13, and the steel ball moves with the arc-shaped spiral groove of the inner wall of the grip rod 12 in cooperation, so that the pushing and telescoping operation of the retractable rod 13 is smooth and stable, and the processing technology of the structure is simple and the cost is low.

As a specific embodiment, the base 25 is provided with two supporting shafts 251. The two supporting shafts 251 penetrate the supporting plate 252 and the positioning plate 253 from two sides of the supporting plate 252 and the positioning plate 253, so that the weight plate 11 can be supported and limited from two sides of the weight plate 11, and the overall support of the dumbbell 10 is better.

The basic principles, main features, and advantages of the present disclosure are shown and described above. Those skilled in the art should understand that the above-described embodiments do not limit the present disclosure in any form, and any technical solution obtained by equivalent substitution or equivalent conversion falls within the scope of protection of the present disclosure.

What is claimed is:

1. An automatic plate-changing integrated dumbbell, comprising:

a dumbbell and a base to limit and place the dumbbell;

wherein two ends of the base are respectively provided with supporting plates to limit and place a plurality of weight plates at two ends of the dumbbell and positioning plates to position and place the dumbbell;

a placement space to place the plurality of weight plates is formed between the supporting plate and the positioning plate;

the dumbbell comprises: a grip rod;

two retractable rods are telescopically mounted inside the grip rod to support the plurality of weight plates at the ends of the dumbbell;

a spiral driving groove is formed inside the grip rod to drive the retractable rod to expand and retract;

an outer periphery of the retractable rod is formed with a driving protrusion to match the spiral driving groove;

through holes are formed at a center of the plurality of weight plates to be inserted with the retractable rod;

two ends of the grip rod are respectively provided with indexing-telescoping assemblies to limit linear movements of the two retractable rods and to index and telescope the retractable rods, so that each degree of rotating the retractable rod corresponds to a position of one weight plate; and the retractable rod is provided with a weight plate fixing assembly to drive and fix the weight plates in case where the retractable rod is prevented from expanding and retracting by the indexing-telescoping assembly, or to drive and release the weight plates in case where the retractable rod is allowed to expand and retract by the indexing-telescoping assembly;

wherein the indexing-telescoping assembly comprises:

a flange plate, rotatably connected to an end of the grip rod; and an indexing ring, fixed to the end of the grip rod and embedded inside the flange plate;

wherein a plurality of indexing pins is provided inside a plurality of indexing holes evenly distributed in a circumferential direction of the indexing ring;

the flange plate is formed with a positioning hole for the indexing pin to be inserted to prevent the retractable rod and the grip rod from rotating relatively;

the indexing pin is provided with a spring to insert a pinhead of the indexing pin into the positioning hole;

the positioning plate is provided with a release pin to insert the positioning hole to eject the indexing pin out of the positioning hole in case where the dumbbell is placed on the positioning plate;

the flange plate is provided with an L-shaped guide seat to limit the linear movement of the retractable rod;

the retractable rod is formed with a guide groove to match the L-shaped guide seat;

the L-shaped guide seat is provided with an ejector rod slidably arranged in the hole formed in the L-shaped guide seat; and the ejector rod moves between a position where the ejector rod is inserted into the indexing hole and a position where the ejector rod disengages from the indexing hole and retracts into a hole formed in the L-shaped guide seat.

2. The automatic plate-changing integrated dumbbell according to claim 1, wherein the indexing-telescoping assembly further comprises a code ring and a pressing cover;

the code ring is sleeved on an outer periphery of the end of the grip rod and a gap is formed between the code ring and the grip rod;

the pressing cover is sleeved on an outer periphery of the grip rod and is expanded into the gap to fix the code ring to the end of the grip rod; and the pressing cover, the code ring, and the indexing ring are fixed as a whole by a plurality of screws.

3. The automatic plate-changing integrated dumbbell according to claim 2, wherein a part of the flange plate is sleeved on an outer periphery of the indexing ring, and a retaining ring is further provided between the flange plate and the indexing ring to limit axial positions of the flange plate and the indexing ring.

4. The automatic plate-changing integrated dumbbell according to claim 2, wherein the positioning plate is formed with a recess to engage with the flange plate; and the recess is provided with the release pin.

5. The automatic plate-changing integrated dumbbell according to claim 1, wherein a part of the flange plate is sleeved on an outer periphery of the indexing ring, and a retaining ring is further provided between the flange plate and the indexing ring to limit axial positions of the flange plate and the indexing ring.

6. The automatic plate-changing integrated dumbbell according to claim 5, wherein the positioning plate is formed with a recess to engage with the flange plate; and the recess is provided with the release pin.

7. The automatic plate-changing integrated dumbbell according to claim 1, wherein the spiral driving groove is a spiral groove having an arc-shaped inner wall; and the driving protrusion is formed by a steel ball rolling embedded on an outer wall of the retractable rod.

8. The automatic plate-changing integrated dumbbell according to claim 7, wherein the positioning plate is formed with a recess to engage with the flange plate; and the recess is provided with the release pin.

9. The automatic plate-changing integrated dumbbell according to claim 1, wherein the weight plate fixing assembly comprises a rotating shaft rotatably arranged inside the retractable rod;

an end of the rotating shaft away from the grip rod is fixed with a cam;

an end of the retractable rod away from the grip rod is provided with a clamping pin;

the through hole of the weight plate is provided with a clamping groove to clamp the clamping pin;

the clamping pin is telescopically arranged in a sliding hole formed at an end of the retractable rod by an elastic member;

a torsion spring is arranged between an end of the rotating shaft away from the cam and an inner wall of the retractable rod, to drive a convex portion of the cam to eject the clamping pin; and an end of the ejector rod is connected to the rotating shaft to push the rotating shaft to rotate in case where the ejector rod is ejected out of the indexing hole by the indexing pin, so as to misalign the convex portion of the cam with the clamping pin and cause the clamping pin to retract back into the sliding hole.

10. The automatic plate-changing integrated dumbbell according to claim 9, wherein the rotating shaft is formed with a toggle rim to contact the ejector rod;

an upper end of the ejector rod is provided with an arc-shaped push rod; and an end of the arc-shaped push rod is abutted and contacted against the toggle rim and is attached to the rotating shaft.

11. The automatic plate-changing integrated dumbbell according to claim 10, wherein the end of the retractable rod is provided with a plurality of clamping pins in the circumferential direction;

a plurality of convex portions and concave portions provided at intervals are formed on a periphery of the cam; and each clamping pin is movable between contacting the corresponding convex portion and contacting the corresponding concave portion.

12. The automatic plate-changing integrated dumbbell according to claim 10, wherein the positioning plate is formed with a recess to engage with the flange plate; and the recess is provided with the release pin.

13. The automatic plate-changing integrated dumbbell according to claim 9, wherein the end of the retractable rod is provided with a plurality of clamping pins in the circumferential direction;

a plurality of convex portions and concave portions provided at intervals are formed on a periphery of the cam; and each clamping pin is movable between contacting the corresponding convex portion and contacting the corresponding concave portion.

14. The automatic plate-changing integrated dumbbell according to claim 9, wherein the positioning plate is formed with a recess to engage with the flange plate; and the recess is provided with the release pin.

15. The automatic plate-changing integrated dumbbell according to claim 1, wherein the positioning plate is formed with a recess to engage with the flange plate; and the recess is provided with the release pin.

16. The automatic plate-changing integrated dumbbell according to claim 1, wherein the spiral driving groove is a spiral groove having an arc-shaped inner wall; and the driving protrusion is formed by a steel ball embedded on an outer wall of the retractable rod.

* * * * *